US006851223B2

(12) United States Patent
Rogers, Jr. et al.

(10) Patent No.: US 6,851,223 B2
(45) Date of Patent: Feb. 8, 2005

(54) VEHICLE DOOR CINCHING METHOD

(75) Inventors: Lloyd Walker Rogers, Jr., Shelby Township, MI (US); Michael Antonio Ciavaglia, Dearborn, MI (US); Theodore J. Lindsay, Shelby Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 83 days.

(21) Appl. No.: 10/449,389

(22) Filed: May 30, 2003

(65) Prior Publication Data

US 2003/0192255 A1 Oct. 16, 2003

Related U.S. Application Data

(62) Division of application No. 10/080,808, filed on Feb. 22, 2002, now Pat. No. 6,615,545

(60) Provisional application No. 60/274,993, filed on Mar. 12, 2001.

(51) Int. Cl.[7] ..... E06B 3/00

(52) U.S. Cl. ..... 49/506

(58) Field of Search ..... 49/279, 280, 360, 49/506

(56) References Cited

U.S. PATENT DOCUMENTS

| | | | |
|---|---|---|---|
| 6,079,767 | A | 6/2000 | Faubert et al. |
| 6,247,373 | B1 | 6/2001 | Bree et al. |
| 6,256,930 | B1 | 7/2001 | Faubert et al. |
| 6,550,825 | B2 | 4/2003 | Ostrowski et al. |
| 6,561,569 | B1 | 5/2003 | Risdon et al. |
| 6,615,545 | B2 | 9/2003 | Rogers, Jr. et al. |
| 2002/0027365 | A1 * | 3/2002 | Rogers et al. ..... 292/201 |

OTHER PUBLICATIONS

Derwent–Acc–No: 1992–305976, Title: Vehicle Door Cinching Mechanism Energises Motor to Turn Jack Screw Which Draws Door to Fully Closed Position and Extends Plunger Date: Jul. 20, 1992 Pub No: RD 340086A pp. : 3 pages.*

* cited by examiner

*Primary Examiner*—Jerry Redman
(74) *Attorney, Agent, or Firm*—Scott A. McBain

(57) ABSTRACT

A vehicle door cinching apparatus for assisting the final closing motion of a sliding vehicle door includes an electromagnet, a ferrous metal plate, a cinch drive and a controller. The electromagnet mounts on either an outer periphery of a vehicle sliding door or an inner periphery of a vehicle sliding door frame that's shaped to receive the sliding door as the door moves along a final inward cinching portion of a door path to a final closed position within the door frame. The plate is supported on the other of the outer periphery of the door and the inner periphery of the door frame in a position where the plate can magnetically engage the electromagnet when the door is disposed along the final cinching portion of the door path. Whichever of the plate and electromagnet is supported on the inner periphery of the door frame is also supported for lateral movement in a direction generally parallel to the cinching portion of the door path. According to the method, the cinch drive moves whichever of the electromagnet and plate is supported on the inner periphery of the door frame to drive the door along the final cinching portion of the door path and into the final closed position. The controller de-energizes the electromagnet and releases the door from the cinching apparatus once the door has reached its final closed position.

6 Claims, 6 Drawing Sheets

VEHICLE DOOR CINCHING METHOD

RELATED APPLICATION

This is a divisional application of U.S. patent application Ser. No. 10/080,808 filed Feb. 22, 2002, now U.S. Pat. No. 6,615,545, which claims benefit of U.S. Provisional patent aplication 60/274,993 filed Mar. 12, 2001.

FIELD OF THE INVENTION

This invention relates generally to a vehicle door cinching method and apparatus for assisting the final closing motion of a sliding vehicle door.

BACKGROUND OF THE INVENTION

As shown in FIGS. 1 and 2, a typical van-type vehicle has a sliding side door. Upper and lower door tracks define a door path that guides the rear to front closing action and front to rear opening action of known sliding doors. The tracks are substantially straight over most of their length, causing the door to move essentially parallel to the body side over most of the door path. The tracks curve sharply inwardly at their respective ends defining a cinching portion of the door path. A center track may also be included to help guide the door during opening and closing.

A typical cable-type closer/opener drives the door through its fore and aft motion along the door path. The cinching portion of the door path causes the door to tilt inwardly in a final closing or cinching motion. As the door moves to its final closed position within a complementary vehicle door frame, the rear or trailing edge of the door tips inwardly and is then driven inward in a motion generally parallel to an inward-facing surface of a C pillar of the door frame. The rear edge continues to move inward along the cinching portion of the door path until an outer surface of the door and an outer surface of the body side panel are generally flush with one another and the door is latched in place.

The final closing action along the cinching portion of the door path typically involves less than an inch of travel. While the final closing motion along the cinching portion of the door path covers only a short distance, it's this final motion that both compresses a weather strip between the door and the frame and latches fork bolt type locks that mechanically hold the door in it's fully closed position. Consequently, the final cinching motion requires more force than what's required to slide the door fore and aft along the door path.

While some systems rely on the cable closer to provide the final closing or cinching force, many systems provide a separate and independent power cinching apparatus. Incorporation of a separate cinching apparatus allows the power opener/closer that moves the door fore and aft to be sized smaller.

Independent power cinchers typically include a powered fork bolt—a somewhat complex mechanism that requires electrical power to unlatch. Because known powered fork bolt cinchers require electrical power to unlatch they also require that a separate manual release be incorporated into the latch to, in the event of power failure, cause the latch to release and allow the door to be opened.

What is needed is a vehicle door cinching apparatus and method that doesn't require electrical power to release a door that has been cinched into its fully closed position.

BRIEF SUMMARY OF THE INVENTION

According to the invention, a vehicle door cinching apparatus is provided for assisting the final closing motion of a sliding vehicle door. The apparatus includes an electromagnet configured to mount on either an outer periphery of a vehicle sliding door or an inner periphery of a vehicle sliding door frame that's shaped to receive the sliding door as the door moves along a final inward cinching portion of a door path to a final closed position within the door frame. A ferrous metal plate is configured to be supported on the other of the outer periphery of the door and the inner periphery of the door frame in a position where the plate is removably magnetically engageable with the electromagnet when the door is disposed along the final cinching portion of the door path. Whichever of the plate and electromagnet is supported on the inner periphery of the door frame is supported for lateral movement in a direction generally parallel to the cinching portion of the door path. A cinch drive is operatively coupled to and configured to drive the lateral movement of whichever of the electromagnet and plate is supported on the inner periphery of the door frame thereby driving the door along the final cinching portion of the door path and into the final closed position when the electromagnet is magnetically connected to the plate. A controller is coupled to the electromagnet and is configured to de-energize the electromagnet and release an engaged door from the cinching apparatus once the door has reached its fully closed position.

The invention also includes a method for assisting the final closing motion of a sliding vehicle door. According to this method one the final closing motion of a sliding vehicle door is assisted by connecting a cinching apparatus to the door when the door reaches a final cinching portion of its door closing path. The cinching apparatus is then operated to move the door to its fully closed position where a separate door latch engages to hold the door in its fully closed position. The cinching apparatus is then operated to release the door.

Because the controller de-energizes the electromagnet once the door has been latched in the fully closed position, no electrical power is required to release the cinching mechanism. This obviates the need for the cincher to include a manual release to open the door in case of a vehicle power failure.

BRIEF DESCRIPTION OF THE SEVERAL VIEWS OF THE DRAWINGS

These and other features and advantages of the invention will become apparent to those skilled in the art in connection with the following detailed description and drawings, in which.

DETAILED DESCRIPTION OF INVENTION EMBODIMENTS

Figure 1:
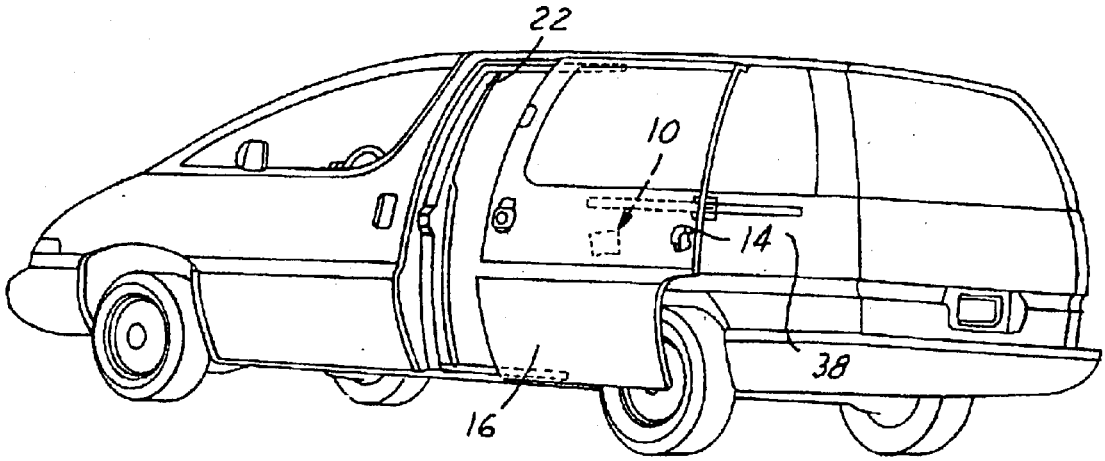
FIG. 1 is a perspective view of a vehicle door cinching apparatus constructed according to the invention and mounted in vehicle having a sliding side door.
Figure 2:
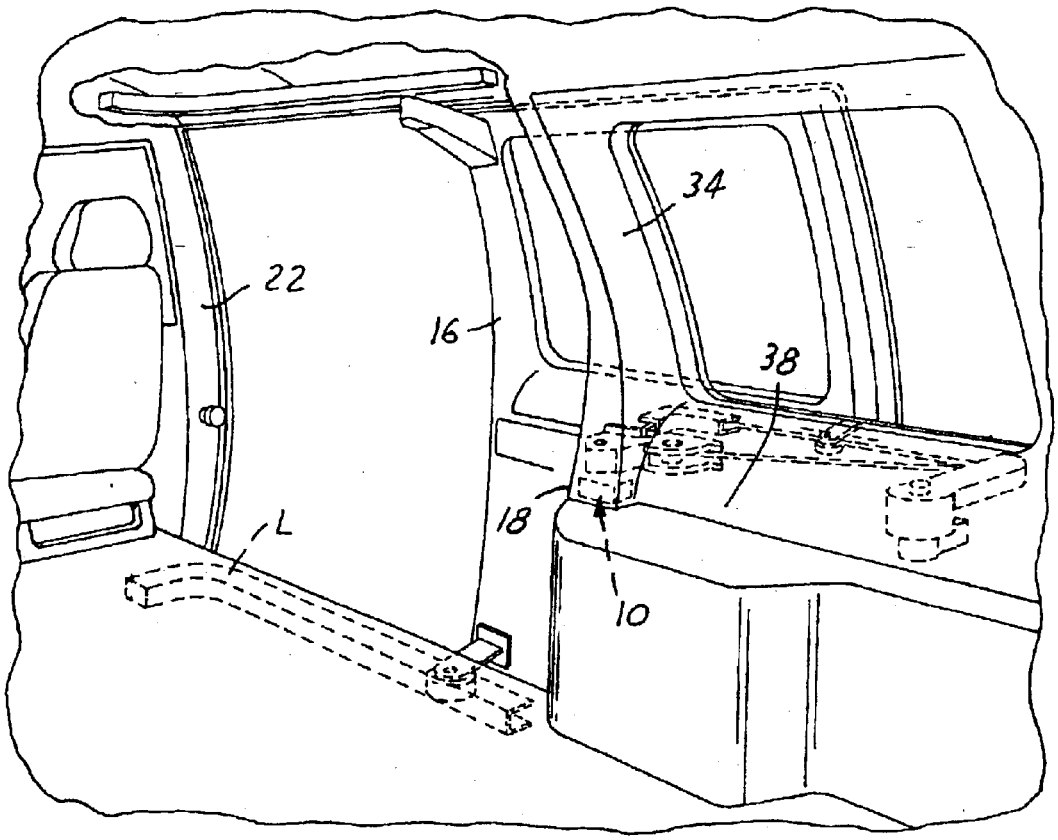
FIG. 2 is a partial perspective interior view of the vehicle and apparatus of FIG. 1.

A vehicle door cinching apparatus for assisting the final closing motion of a sliding vehicle door 16 is shown at 10 in the drawings. The apparatus 10 includes an electromagnet 12 that mounts on either an outer periphery 14 of a vehicle sliding door 16 or an inner periphery of a vehicle sliding door frame 22 that's shaped to receive the sliding door 16 as the door 16 moves along a final inward cinching portion of a door path 20 to a final closed position within the door frame 22.

Figure 6:
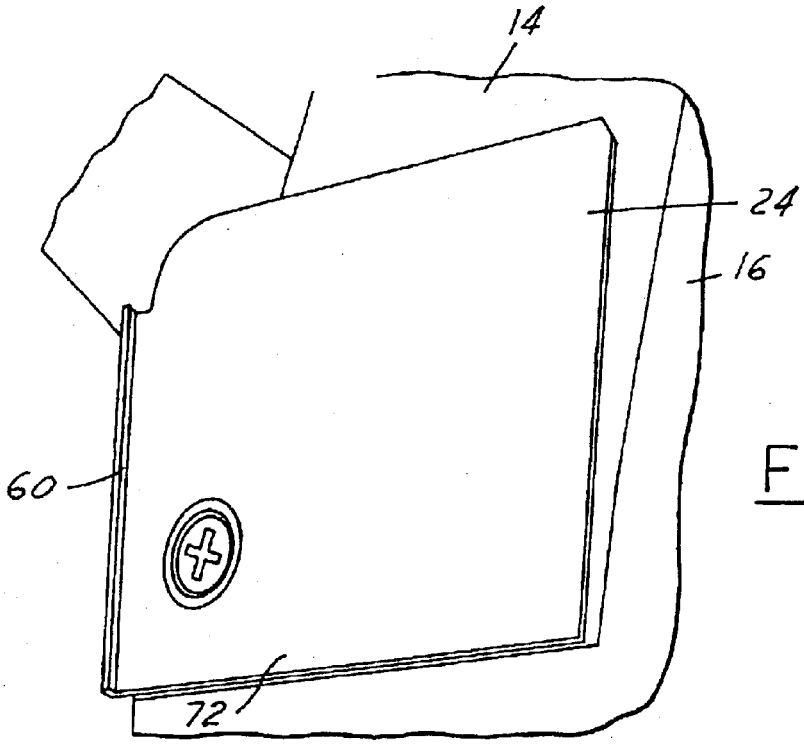
FIG. 6 is a perspective view of a ferrous metal plate of the apparatus of FIG. 1 shown mounted on an outer periphery of a vehicle door.

As best shown in FIG. 6, a ferrous metal plate 24 is supported on the other of the outer periphery 14 of the door 16 and the inner periphery of the door frame 22 in a position where the plate 24 is removably magnetically engageable with the electromagnet 12 when the door 16 is disposed along the final cinching portion of the door path 20. While the present embodiment includes a plate 24 fastened to the outer periphery 14 of a door 16, in other embodiments the plate may be an integral portion of the door or may be formed with the door as a single unitary piece.

While in the present embodiment the electromagnet 12 is configured to be movably supported on the inner periphery of a vehicle door frame 22, and the plate 24 is configured to be supported on the outer periphery 14 of a vehicle door 16, in other embodiments, the electromagnet may be supported on the door and the plate movably supported on the door frame. Whichever of the plate 24 and electromagnet 12 is supported on the inner periphery of the door frame 22 is supported for lateral movement in a direction generally parallel to the cinching portion of the door path 20.

The apparatus 10 also includes a cinch drive 26 operatively coupled with and configured to drive the lateral movement of whichever of the electromagnet 12 and plate 24 is supported on the inner periphery of the door frame 22 to drive the door 16 along the final cinching portion of the door path 20 and into the final closed position when the electromagnet 12 is magnetically connected to the plate 24.

The apparatus 10 also includes a microprocessor controller 28 coupled to the electromagnet 12 and programmed to de-energize the electromagnet 12 and release an engaged door 16 from the cinching apparatus 10 once the door 16 has reached its final closed position. Consequently, no electrical power is required to unlatch the door 16 and there is no need for a manual release that will, in the event of a power failure, unlatch the cincher and allow the door 16 to be opened.

The apparatus 10 includes a carriage 30 supported for movement along a carriage path that includes motion generally parallel to the cinching portion of a door path 20. The cinch drive 26 is operatively coupled with and configured to drive the carriage 30 reciprocally along the carriage path, and the electromagnet 12 is supported on the carriage 30 for reciprocal motion toward and away from the carriage 30. This allows the electromagnet 12 to move away from the carriage 30 far enough to magnetically engage the plate 24.

The electromagnet 12 is spring biased toward the carriage 30 to cause the electromagnet 12 to move against the carriage 30 and away from the plate 24 when the magnet is not energized and is not being drawn or held outward by magnetic engagement with the plate 24.

Figure 4:
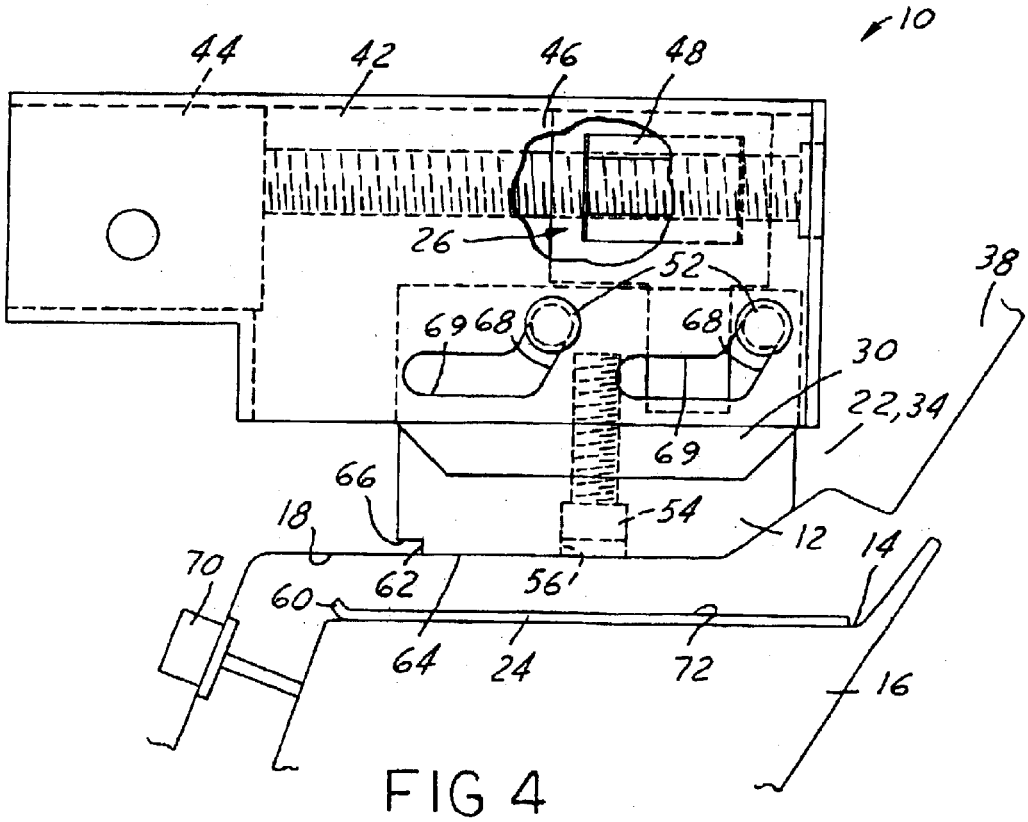
FIG. 4 is a cross-sectional plan view of the vehicle door cinching apparatus of FIG. 1.
Figure 5:
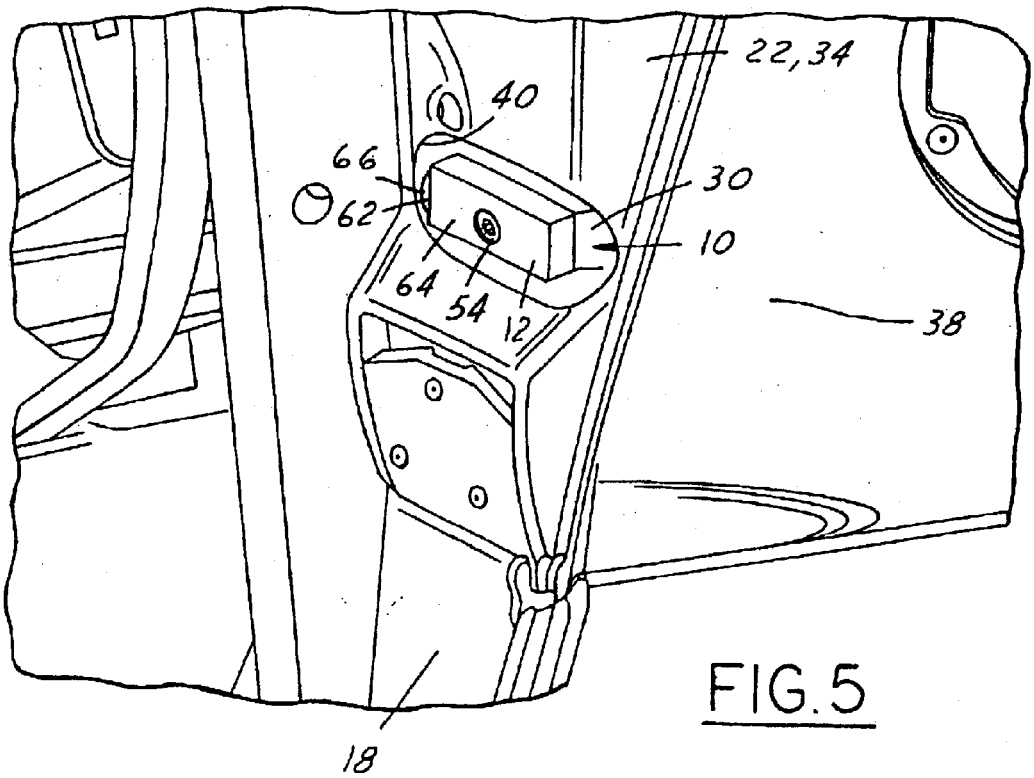
FIG. 5 is a perspective view of the vehicle door cinching apparatus of FIG. 1 as seen through a clearance hole in a C pillar of the vehicle.

As seen in FIGS. 4 and 5, a powered portion of the cinching apparatus 10 is mounted within the C pillar portion 34 of a vehicle door frame 22 and within a side body panel 38 of the vehicle. The electromagnet 12 is supported on the carriage 30 to move in and out, and back and forth within a clearance hole 40 formed in the C pillar 34, as is best seen in FIG. 5. As best seen in FIG. 4, a stationary portion of the powered portion of the cinching apparatus 10 comprises a hollow housing 42 and the cinch drive 26 which includes an electric motor 44, a jackscrew 46 and a jackscrew nut 48 coupled to the carriage 30.

The housing 42 and the motor 44 are rigidly mounted inside the C pillar 34. The jackscrew 46 is disposed inside the housing 42 and is operably connected to and driven by the motor 44. The motor 44 turns the jackscrew 46 which moves the jackscrew nut 48 and carriage 30 back and forth within the housing 42 along a carriage path defined by four generally V-shaped cam slots 50 formed in both upper and lower walls of the housing 42. Four cam follower pins 52 extend from the carriage 30 through the cam slots 50 and cooperate with the cam slots 50 to define the carriage path.

Figure 7:
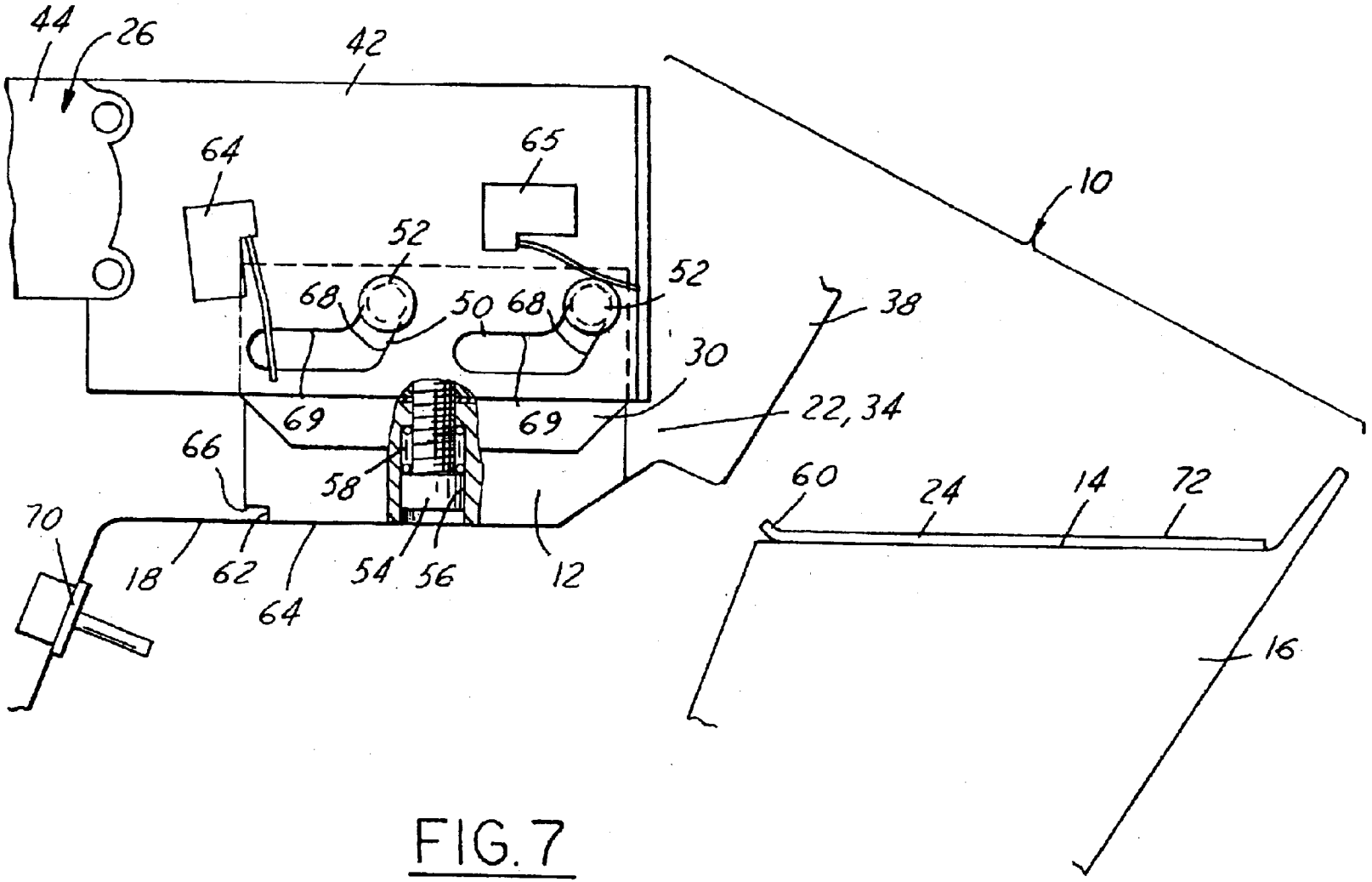
FIG. 7 is a schematic top view of the apparatus of FIG. 1 with its carriage shown in a stowed position, an electromagnet of the apparatus shown retracted against the carriage, and a door of the vehicle shown approaching a final cinching portion of its door closing path.

As best shown in FIG. 7, a shouldered bolt 54 extends from the carriage 30 through an opening 56 in the electromagnet 12. The electromagnet 12 is slidably mounted on the shoulder bolt 54 for reciprocal motion toward and away from the carriage 30. A compression spring, best shown at 58 in FIGS. 7–10, provides the inward bias of the electromagnet 12 toward the carriage 30. The spring 58 causes the electromagnet 12 to move back inwardly against the carriage 30 when the electromagnet 12 is not being drawn outward along the shoulder bolt 54 by magnetic attraction to the metal plate 24 attached to a trailing edge portion of an outer periphery 14 of the door 16.

In the present embodiment the plate 24 is supported on the door 16 periphery in a position to magnetically engage the electromagnet 12 when the door 16 reaches the cinching portion of the door path 20. As such, a non-powered portion of the cinching apparatus 10 includes the plate 24 and any hardware used to fix the plate 24 to the trailing peripheral edge of the door 16. The plate 24 includes an inboard raised lip 60 positioned to engage a leading or inboard edge 62 of a face 64 of the electromagnet. The leading edge 62 of the magnet face 64 includes a notch 66 that defines the leading edge 62 of the magnet face 64 and proves a straighter, sharper-edged engagement surface for a more positive engagement with the lip 60 of the plate 24. The notch 66 also prevents relative sliding motion between the electromagnet 12 and the plate 24 during cinching.

Each of the cam slots 50 includes a first portion 68 shaped to guide the carriage 30 along a first portion of the carriage path toward the plate 24 to carry the electromagnet 12 into a position close enough to the plate 24 to allow magnetic attraction to pull the electromagnet 12 into engagement with the plate 24 when a door 16 that the plate is mounted on reaches the cinching portion of the door path 20 during door 16 closing. Each of the cam slots 50 includes a second portion 69 shaped to guide the carriage 30 along a second portion of the carriage path parallel to the cinching portion of the door path 20 to allow the carriage 30 and electromagnet 12 to pull the door 16 along the cinching portion of the door path 20 into the fully closed position.

In other embodiments the plate 24 may be included in the powered portion of the apparatus 10 and movably supported on the carriage 30. In such embodiments the electromagnet 12 would be included in the non-powered portion of the apparatus 10 and rigidly supported on the door 16.

Figure 3:
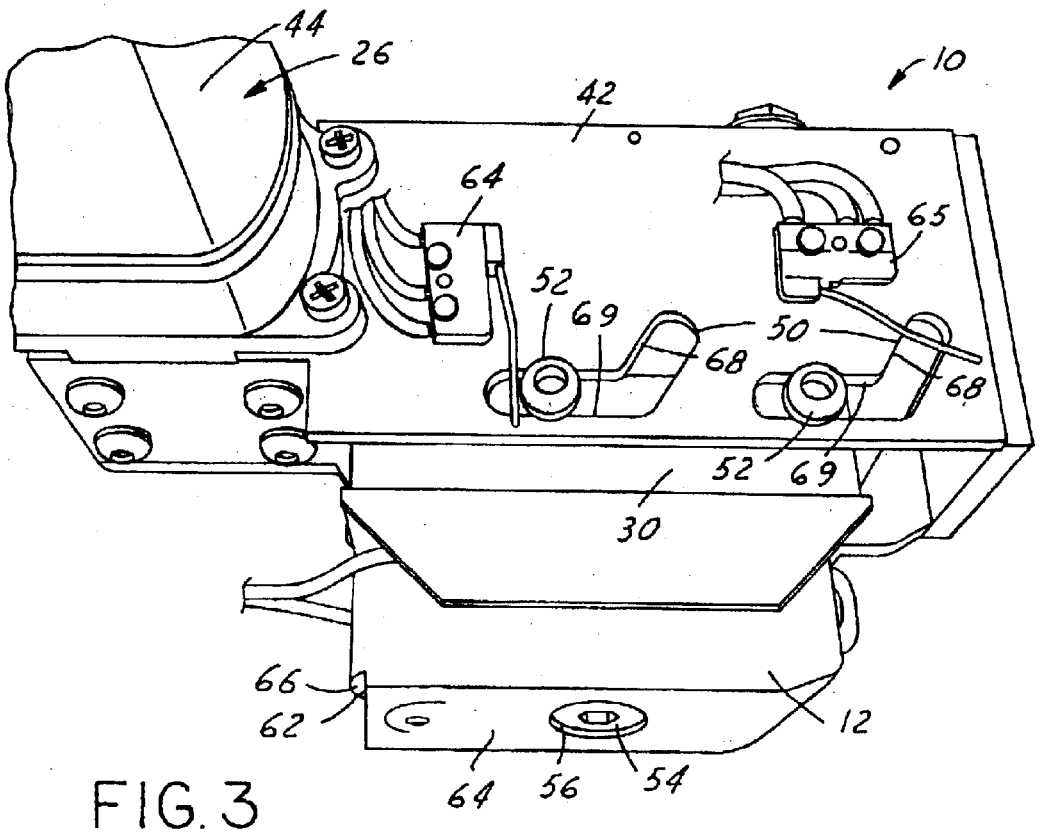
FIG. 3 is a top perspective view of the vehicle door cinching apparatus of FIG. 1.
Figure 11:
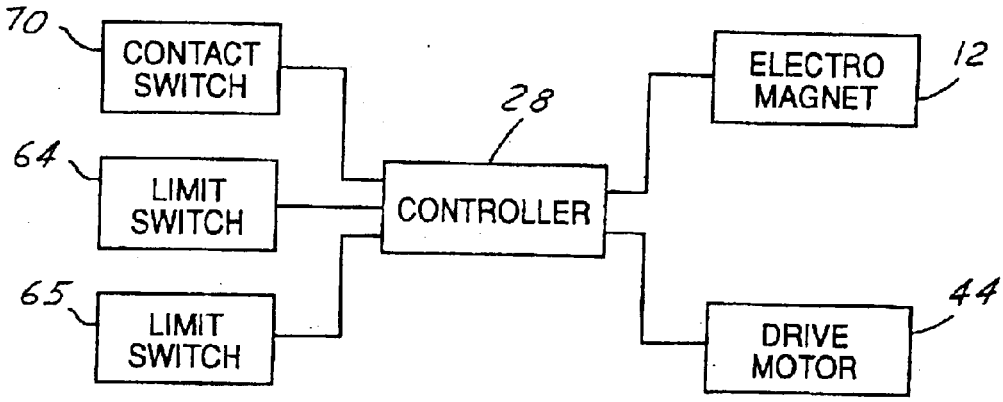
FIG. 11 is a schematic block diagram showing a controller, electromagnet, drive motor and limit switches and sensors of the apparatus of FIG. 1.

First and second sensor and switch combinations in the form of first and second limit switches 64, 65 are supported at the ends of the cam slots 50 as best shown in FIG. 3 and are coupled to the microprocessor controller 28 as shown in FIG. 11. The limit switches 64, 65 sense when the cam follower pins 52 of the carriage 30 are at the respective limits of their travel within the slots 50. When the controller 28 receives a signal from the first limit switch 64 indicating that the first limit switch 64 senses the presence of a pin 52 and that the carriage 30 is in its fully deployed position, the controller 28 shuts off the electromagnet 12 and causes the jackscrew 46 motor 44 to operate in reverse, driving the carriage 30 from its fully extended position toward its stowed position. When the controller 28 receives a signal from the second limit switch 65 indicating that the second limit switch 65 senses the presence of a pin 52 and that the carriage 30 is in its stowed position, the controller 28 shuts off the drive motor 44.

A third sensor and switch combination in the form of a contact switch 70 is mounted on the C pillar 34 and, as with the first and second limit switches 64, 65, is coupled to the controller 28. The contact switch 70 senses when the door 16 is near its closed position and has reached the cinching portion of the door path 20. When the door 16 reaches and enters the cinching portion of the door path 20 the controller 28 receives a signal from the contact switch 70 indicating that the door 16 has contacted the contact switch 70. At this point the controller energizes the electromagnet 12 and causes the drive motor 44 to turn the jackscrew 46 and move the carriage 30 from its stowed position to its fully extended position.

Although, in the present embodiment, the contact switch 70 and limit switches 64, 65 are coupled to a microprocessor controller 28 that is, in turn, coupled to the electromagnet 12 and the drive motor 44, in other embodiments, relays or other suitable switching mechanisms may be employed in place of the microprocessor 28. Alternatively, the contact switch 70 and/or the limit switches 64, 65 may be configured to open and close circuits that alternately energize and de-energize the electromagnet 12 and/or alternately de-energize and drive motor 44 in forward and reverse.

In practice, and as seen in FIG. 7, as the door 16 is sliding closed and is approaching the cinching portion of the door path 20, the carriage 30 is in its stowed, "cinch-ready" position, rearward and outboard within the housing 42. In the stowed position, the cam-follower pins 52 are seated against respective ends of the first portions 68 of the cam slots 50. Because one of the pins 52 is compressing the second limit switch 65, the drive motor 44 is prevented from operating. Because the contact switch 70 is not compressed, the electromagnet 12 is de-energized and the spring 58 is shown holding it inwardly against the carriage 30—retracted within the clearance hole 40 in the C pillar 34.

Figure 8:
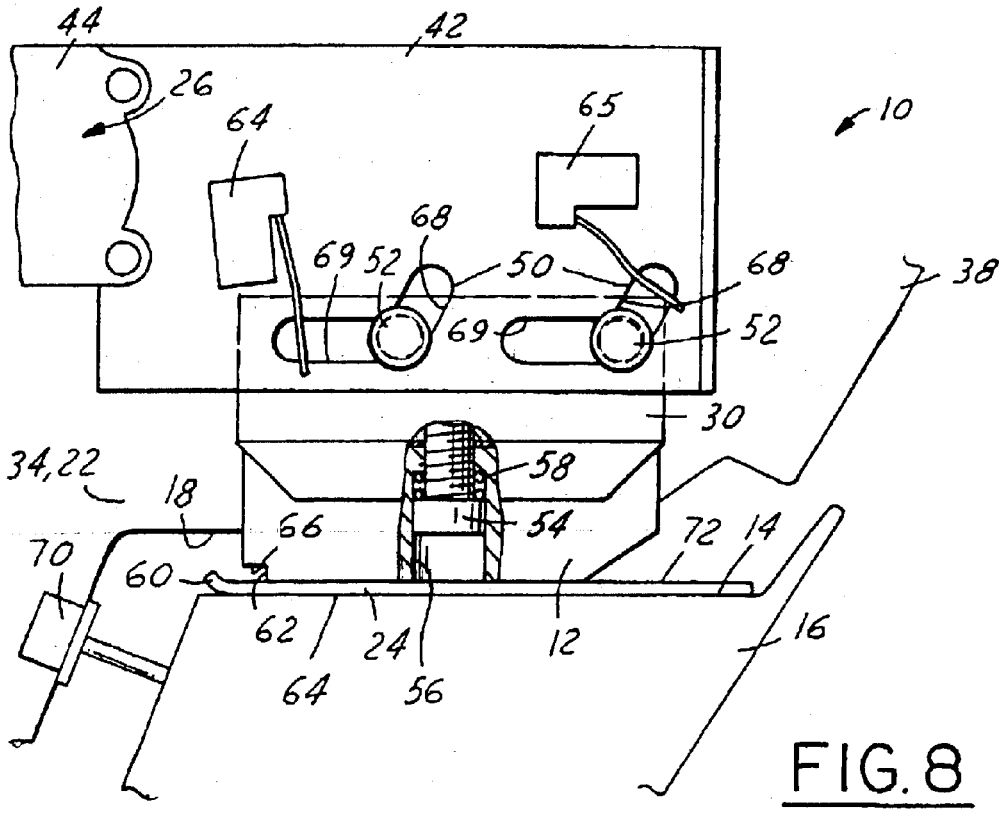
FIG. 8 is a schematic top view of the apparatus of FIG. 1 with its carriage shown at the end of a first portion of a carriage path and the beginning of a second portion of the carriage path, the door shown at the beginning of the final cinching portion of the door path, and the electromagnet shown spaced from the carriage and in magnetic engagement with the approximate center of the plate of FIG. 6.

As seen in FIG. 8, when the door 16 has moved to the position shown, a power door closing mechanism has moved the door 16 approximately as far as it can and the cinching apparatus 10 must take over to provide the needed final closing force to move the door 16 along the cinching portion of the door path 20 to the fully closed position. Because the contact switch 70 is engaged and actuated at this point, it causes the motor 44 to begin turning the jackscrew 46. The jackscrew 46 turns within the jackscrew nut 48, driving the carriage 30 inboard and forward along the first portion 28 of the carriage path toward the plate 24 as the pins 52 move forward along the respective first portions 68 of the cam slots 50, thus releasing limit second limit switch 65. Simultaneously, actuation of the contact switch 70 causes electromagnet 12 to be energized. As the carriage 30 carries the electromagnet 12 closer to the plate 24, electromagnetic attraction pulls the electromagnet 12 away from the carriage 30 against the force of the spring 58, along the bolt 54 and into engagement with the plate 24.

Figure 9:
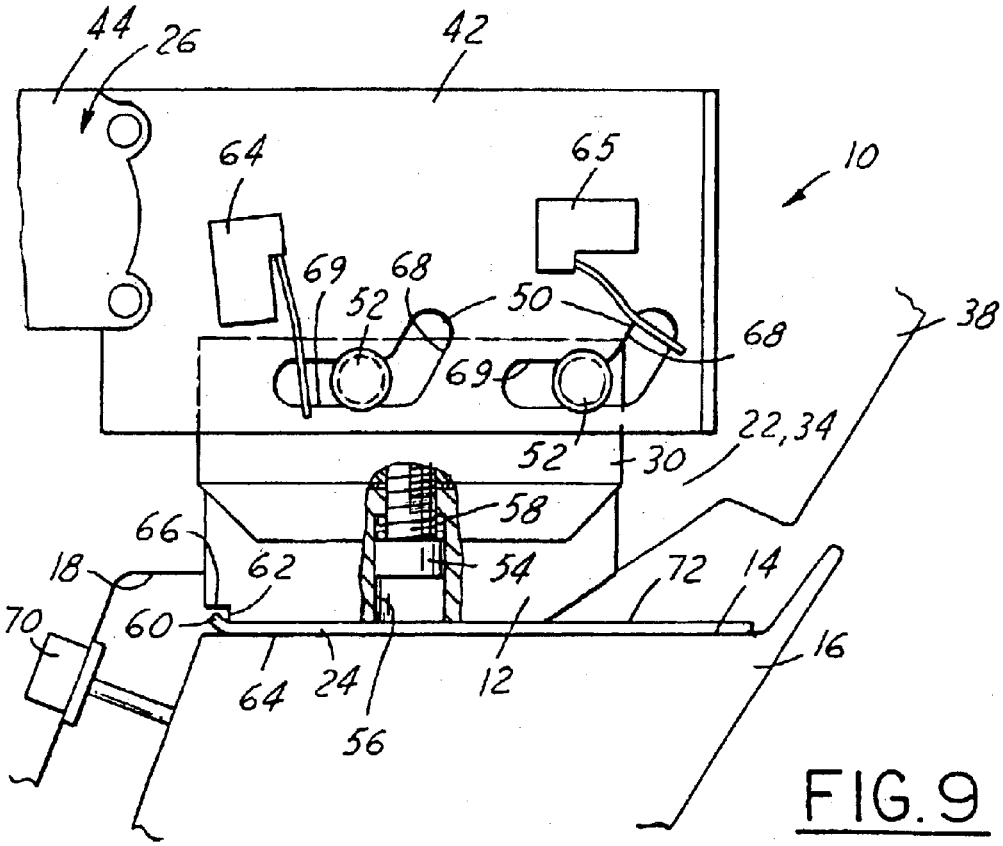
FIG. 9 is a schematic top view of the apparatus of FIG. 1 with its carriage shown approximately midway along the second portion of the carriage path, a leading edge of the electromagnet shown to have slid into engagement with a raised lip of the plate, and the door beginning to move along the final cinching portion of the door path.

As seen in FIG. 9, as the carriage 30 moves along the second portion of the carriage path within housing 42, guided by the pins 52 as they follow along the respective second portions 69 of their corresponding cam slots 50, the face of the electromagnet 12 slides along a face 72 of the plate 24 until the lip 60 of the plate 24 enters and engages notch 66 on the electromagnet 12. The lip-notch interface provides sufficient interference to allow the drive 26 to use the moving electromagnet-carriage assembly to pull the door 16 along the cinch portion of the door path 20 into its final closed position shown in FIG. 10. As the door 16 reaches its final closed position a standard mechanical latch assembly (not shown) engages to hold the door 16 in the final closed position.

Figure 10:
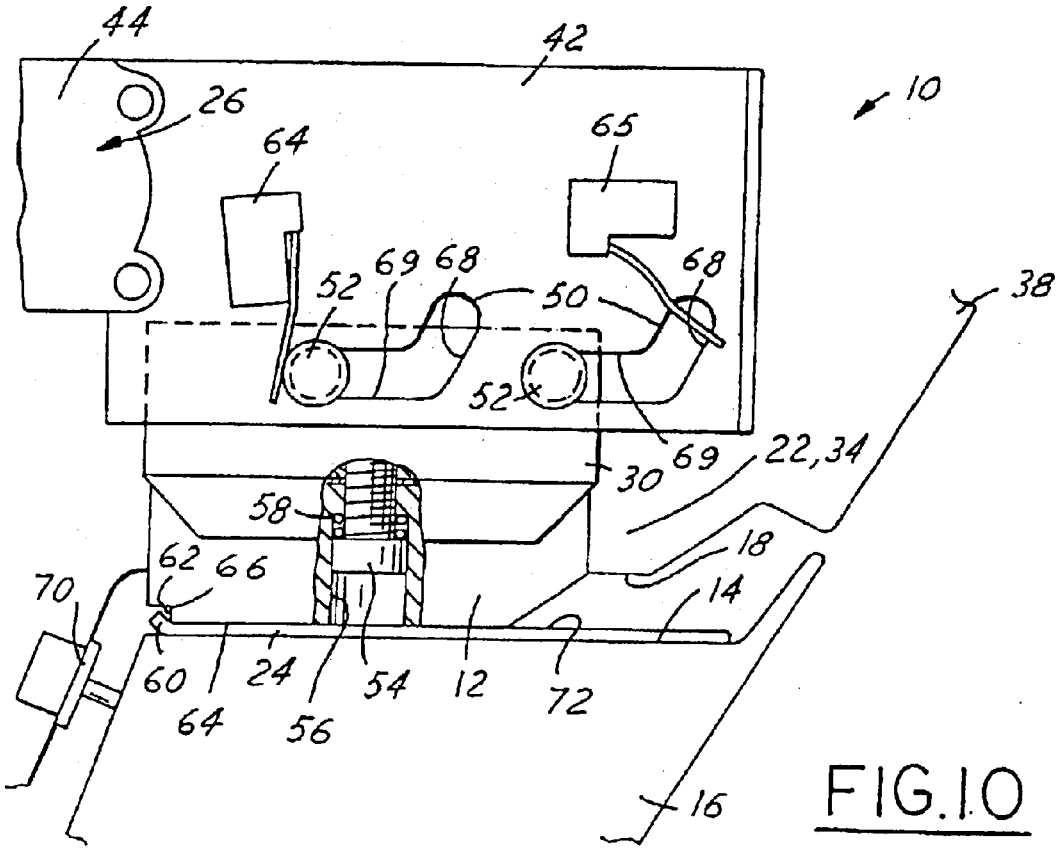
FIG. 10 is a schematic top view of the apparatus of FIG. 1 with its carriage shown at the end of the second portion of the carriage path, the door shown in its fully closed position and the electromagnet still in magnetic engagement with the plate.

As seen in FIG. 10, when the door 16 has reached its final closed position, the pins 52 have reached the ends of the cam slots 50. At this point, one of the pins 52 engages and depresses the first limit switch 64 which signals the controller 28 to de-energize the electromagnet 12. This causes the electromagnet 12 to release the plate 24 and allow the spring 58 to expand, pulling the electromagnet 12 back against the carriage 30. Concurrently, depression of the first limit switch 64 will signal the controller 28 to cause the drive motor 44 to turn the jackscrew 46 in reverse, shifting the carriage 30 back to its stowed position equivalent to its FIG. 7 position and re-engaging the second limit switch 65. Re-engagement of the second limit switch causes the motor 44 to stop turning the jackscrew 46, leaving the carriage 30 in its stowed, "cinch-ready" position.

The carriage 30 remains in the cinch-ready position when the door 16 is eventually re-opened, and until the door has again closed to the final cinching portion of the door path 20. The cinching operation then resumes as described above. Therefore, following each cinching operation, the vehicle door cinching apparatus 10 is fully disengaged from the door, allowing the door to be unlatched and opened without interference from the cinching apparatus 10—even when there is no electrical power available to operate the cinching apparatus 10.

This description is intended to illustrate certain embodiments of the invention rather than to limit the invention. Therefore, it uses descriptive rather than limiting words.

Obviously, it's possible to modify this invention from what the description teaches. Within the scope of the claims, one may practice the invention other than as described.

We claim:

1. A method of assisting the final closing motion of a sliding vehicle door in a vehicle frame comprising:

connecting the sliding vehicle door to the door frame via a cinching apparatus when the sliding vehicle door reaches a final cinching portion of a door path by extending a retracted reciprocable magnet of the cinching apparatus, causing the cinching apparatus to move the sliding vehicle door to its fully closed position after connecting the sliding vehicle door to the door frame by moving the magnet laterally, latching the door in its fully closed position once the cinching apparatus has moved the sliding vehicle door to its fully closed position, and disconnecting the sliding vehicle door from the door frame via the cinching apparatus by retracting the reciprocable magnet.

2. A method of assisting the final closing motion of a sliding vehicle door in a vehicle frame comprising:

connecting the sliding vehicle door to the door frame via a cinching apparatus when the sliding vehicle door reaches a final cinching portion of a door path by energizing a retracted reciprocable electromagnet of the cinching apparatus to extend into engagement with a magnetic member, causing the cinching apparatus to move the sliding vehicle door to its fully closed position after connecting the sliding vehicle door to the door frame by moving the energized electromagnet laterally, latching the door in its fully closed position once the cinching apparatus has moved the sliding vehicle door to its fully closed position, and disconnecting the sliding vehicle door from the door frame via the cinching apparatus by deenergizing and retracting the electromagnet.

3. A method of assisting the final closing motion of a sliding vehicle door in a vehicle frame comprising:

connecting the sliding vehicle door to the door frame via a cinching apparatus when the sliding vehicle door reaches a final cinching portion of a door path by energizing a reciprocable electromagnet of the cinching apparatus to extend along an inclined path into engagement with a magnetic member, moving the energized electromagnet laterally with respect to the inclined path along a face of the magnetic member until there is an interference between the energized electromagnet and the magnetic member, causing the cinching apparatus to move the sliding vehicle door to its fully closed position after the interference by further moving the energized electromagnet laterally, latching the door in its fully closed position once the cinching apparatus has moved the sliding vehicle door to its fully closed position, and disconnecting the sliding vehicle door from the door frame via the cinching apparatus by deenergizing and retracting the electromagnet.

4. The method as defined in claim 3 wherein retracting the electromagnet comprises moving the electromagnet laterally along the face of the magnetic member and along the inclined path.

5. The method as defined in claim 4 wherein the electromagnet is moved laterally by a motor.

6. The method as defined in claim 5 wherein the electromagnet is retracted along the inclined path by a spring.

* * * * *